United States Patent [19]

Ono

[11] Patent Number: 4,796,320

[45] Date of Patent: Jan. 10, 1989

[54] METHOD OF DYEING AND HYDRO-EXTRACTING COLLECTIVELY YARN CHEESES AND APPARATUS THEREFOR

[75] Inventor: Nobutaka Ono, Ashiya, Japan

[73] Assignee: Osaka Bobbin Kabushiki Kaisha, Osaka, Japan

[21] Appl. No.: 129,859

[22] Filed: Dec. 30, 1987

[30] Foreign Application Priority Data

Jul. 11, 1987 [JP] Japan ..... 62-173479

[51] Int. Cl.[4] ..... D06B 3/04

[52] U.S. Cl. ..... 8/155.2; 68/13 R; 68/10; 68/11; 242/35.5 A

[58] Field of Search ..... 68/13 R, 10, 11, 212; 8/155.2; 242/35.5 A

[56] References Cited

U.S. PATENT DOCUMENTS

| | | | |
|---|---|---|---|
| 1,867,197 | 7/1932 | Volk | 68/11 X |
| 3,512,193 | 5/1970 | Kronsbein | 68/10 X |
| 3,686,899 | 8/1972 | Rosenfeld et al. | 68/10 X |
| 4,224,866 | 9/1980 | Geyer, Jr. et al. | 68/13 R X |
| 4,555,067 | 11/1985 | Angelucci et al. | 242/35.5 A |
| 4,591,106 | 5/1986 | Gay | 242/35.5 A X |
| 4,729,709 | 3/1988 | Raasch | 242/35.5 A X |

*Primary Examiner*—Harvey C. Hornsby
*Assistant Examiner*—Frankie L. Stinson
*Attorney, Agent, or Firm*—Flynn, Thiel, Boutell & Tanis

[57] ABSTRACT

Mass treatment system for dyeing and hydro-extracting yarn cheeses sequentially and automatically which comprises a combination of: a circulation rail resting thereon a plurality of mobile trucks which are adapted to mount thereon cheese spindles and convey them to each treatment station; cheese pressing means including extension spindle inserting means and means for inserting a plurality of cheeses at a time on empty spindles surmounted with the extension spindles; dyeing means including loading means of cheese-spindles on a carrier for charging into a dyeing machine and a turntable for charging or discharging the loaded carrier rested thereon into or from the dyeing machine; transfer means of as-dyed cheese-spindles onto the trucks; hydro-extracting means including means for transferring dyed cheese-spindles into a hydro-extracting basket, means for placing the basket thus filled in a hydro-extractor, and means for discharging hydro-extracted cheeses along with the basket and transferring them to the trucks; drying means including means for aligning and introducing cheeses into a dryer; and cheese delivery and conveying means to cartons.

3 Claims, 8 Drawing Sheets

METHOD OF DYEING AND HYDRO-EXTRACTING COLLECTIVELY YARN CHEESES AND APPARATUS THEREFOR

BACKGROUND OF THE INVENTION

1. Field of the Invention:

This invention relates to a mass treatment system for dyeing and hydro-extracting collectively yarn cheeses in order to efficiently perform sequentially a series of steps extending from mounting of cheeses on spindles, dyeing, hydro-extracting to drying.

2. Statement of Related Art:

Heretofore, in dyeing yarn cheeses, it has been a common practice to conduct separately and independently respective steps of filling each spindle with yarn cheeses, pressing the cheeses with the aid of a press machine in the direction of the spindles, loading the spindles having cheeses mounted thereon on a carrier, dyeing, demounting the cheeses from the spindles, hydro-extracting and drying. Consequently, each of the apparatuses and components used for these steps have been investigated individually or independently and various approaches have been proposed. For instance, a cheese press machine was proposed and disclosed in Japanese U.M. Publication No. 51-27335 (1976), a quick-releasable spindle fastening device in U.S. Pat. No. 4,423,609, a cheese lift device for demounting cheeses in Japanese Patent Publication No. 52-31462 (1977), and a hydro-extractor in U.S. Pat. No. 4,464,846.

These proposed devices can display respectively superior functions in performing independently respective steps, but nevertheless, have not been satisfactory in terms of sequential systematization wherein a series of the steps are conducted sequentially using a computer and robot.

With a current trend toward sequential systematization, dyeing system is not an exception to it and such a dyeing system that is adapted to systematization has been desired.

In order to cope with such systematization and to complete a sequential system of dyeing and hydro-extracting yarn cheeses, the present inventor has made an extensive investigation before. As a result, by a development of a rail arrangement for linking respective steps and utilization of a variety of automated devices, the inventor has proposed a method and apparatus for performing sequentially a series of steps of filling spindles with yarn cheeses, dyeing, hydro-extracting and drying (Japanese Published patent application No. 61-258066 (1986)).

According to this method, sequential steps are effected in a flow system: Spindles capable of readily attaching or detaching to a carrier in a onetouch manner are mounted on crawler trucks and collected in front of a press machine; a predetermined number of yarn cheeses wherein yarn is wound up around bobbins that are compressible in the longitudinal direction (spindle direction) are inserted automatically or manually on each spindle until a definite number has been reached and then, each spacer is attached; a press machine is actuated automatically or manually to press the cheeses; each truck carrying thereon the spindle mounted with cheeses is brought into crawling and travelled to a location where the cheese-mounted spindles are automatically or manually loaded one after another on an empty carrier; the carrier filled with the cheese-mounted spindles is placed in a dyeing machine to effect dyeing.

After dyeing, as-dyed cheese-mounted spindles are discharged together with the carrier from the dyeing machine, carried automatically or manually on the trucks which are now unoccupied at the location where the cheeses -spindles were transferred to the carrier, and conveyed to the front of a hydro-extractor; the cheeses are dismounted and every one or several number of them are placed separately in respective hydro-extractors to effect hydro-extraction; the cheeses thus hydro-extracted are carried on a belt conveyor or a box with the aid of a robot or the like, placed in a dryer to dry and finally delivered.

However, in performing a series of the foregoing steps, it has been found that the foregoing steps still allow of further rationalization whereby it is possible to augment productivity.

Accordingly, this invention is aimed at treating a plurality of yarn cheeses at a time and simplifying the motions of cheeses, thus achieving automation of cheese treatment.

SUMMARY OF THE INVENTION

According to this invention, the aforesaid object can be attained by an improvement over the former sequential system of dyeing, hydro-extraction and drying; and this invention resides in a method and apparatus for dyeing and hydro-extracting collectively yarn cheeses as described below.

According to one aspect of this invention, there is provided a method of dyeing and hydro-extracting yarn cheeses collectively which comprises conveying empty spindles loaded on mobile trucks following a rail; inserting extension spindles; inserting a plurality of yarn cheeses wound up around bobbins which are fed from a carton on the spindles surmounted with the extension spindles at a time until a definite number has been reached; mounting spacers; pressing the cheeses in the spindle direction with the aid of a press machine; removing the extension spindles; locking with fasteners to make cheese-mounted spindles; further conveying the cheese-mounted spindles on the trucks following the rail to a location of turntable; loading a definite number of the cheese-mounted spindles on a carrier on the turntable; charging the carrier thus loaded in a dyeing machine to effect cheese dyeing; discharging as-dyed cheese-mounted spindles together with the carrier from the dyeing machine to return them on the turntable; mounting again the dyed cheese-mounted spindles on the mobile trucks on the rail to transport them following the rail; releasing the fasteners and spacers, then demounting the dyed cheeses from the spindles to house a definite number of them in a hydro-extracting basket and charging the basket in a hydro-extractor to effect hydro-extraction treatment; transferring the cheeses as hydro-extracted on a conveyor and aligning them; placing the cheeses in a drying device to dry for a required duration of time; delivering and collecting the cheeses to store them in cartons while returning the unoccupied spindles to the initial position, whereby a series of operations starting from mounting of yarn cheeses on empty spindles, ending in hydro-extraction of dyed cheeses and drying are performed systemically according to their sequence.

According to another aspect of this invention, there is provided an apparatus for mass treatment of dyeing and hydro-extraction on which to perform continuously a series of steps of inserting yarn cheeses wound up around bobbins on spindles, cheese pressing, loading on a carrier, dyeing, hydro-extraction, drying and storage in a carton, which apparatus comprises a combination of means (a) to (h):

(a) Rail means for spindle transfer provided with a plurality of mobile trucks thereon comprising a first rail portion for mounting empty spindles on trucks to convey them to a cheese mounting station downstream, a second rail portion for conveying cheese-mounted spindles on the trucks to a downstream station for dyeing treatment; a third rail portion for conveying dyed cheese-mounted spindles on the trucks to a downstream hydro-extraction station, a fourth rail portion for conveying hydro-extracted cheese-mounted spindles to a drying station, and a fifth return rail portion for restoring unoccupied spindles released from cheeses thus dried to the initial, empty spindle mounting station, thus linking to form a circulation rail system.

(b) A series of means including a robot disposed alongside of the first rail portion for empty spindle mounting and the second rail portion for cheese-mounted spindles, which comprise means for inserting extension spindles onto empty spindles, means for feeding simultaneously a plurality of cheeses from a cheese pool and inserting them on empty spindles surmounted with extension spindles until a predetermined number has been reached, means for inserting spacers, means for inserting blind bobbins, means for pressing cheeses in the spindle direction, and means for removing the extension spindles after pressing and returning them to the initial location while locking the upper ends of the spindles with fasteners.

(c) Means disposed alongside of the second rail portion of cheese-mounted spindles and the third rail portion of dyed cheese-mounted spindles which comprises means for loading the cheese-mounted spindles on a carrier for charging in a dyeing machine, a turntable for placing the carrier loaded with cheese-mounted spindles into the dyeing machine or restoring dyed cheese-mounted spindles discharged from the dyeing machine together with the carrier, and a dyeing machine for dyeing the cheeses placed therein.

(d) Transfer means, disposed adjacent to the turntable, for transferring dyed cheese-mounted spindles to the trucks which are on the third rail portion of dyed cheese-mounted spindles.

(e) Means for releasing the fasteners, blind bobbins and spacers from the dyed cheese-mounted spindles, which means is disposed along the third rail portion.

(f) Hydro-extracting means disposed downstream of the release means along the fourth rail portion of hydro-extracted cheese-mounted spindles comprising a hydro-extractor, a hydro-extracting basket, means for transferring the dyed cheeses into a hydro-extracting basket, means for charging the hydro-extracting basket housing therein the dyed cheeses into the hydro-extractor by hanging, and means for discharging the basket housing hydro-extracted cheeses from the hydro-extractor at discharge location and transferring the hydro-extracted cheeses onto the mobile trucks travelling on the rail.

(g) Drying means comprising cheese transfer means for aligning the hydro-extracted cheeses conveyed on the fourth rail portion after discharging from hydro-extractor in every plural number and placing the aligned cheeses into a dryer at a time, and a dryer for receiving them to dry.

(h) Delivery and conveyor means for receiving dried cheeses thereon and conveying them to a carton location, which means is disposed at the outlet of the dryer.

The method and apparatus pertaining to this invention are fundamentally predicated on the principles of:

(1) treating a lot of cheeses simultaneously during a single operation, (2) utilizing economical devices without using costly devices as far as possible, (3) operating mainly by three-dimensional orthogonal motions and rotation, for the purposes of time saving and trouble prevention, and positioning precisely with a positioning frame or the like. Thus, this invention can be effectively carried out.

More specifically stated, the gist of this invention consists in the operations which will be stated below.

(i) Bobbins would up with yarn, namely, yarn cheeses are fed from a carton simultaneously in every plural number and inserted on the spindles each attached on the mobile truck.

(ii) Plural number of cheeses on each truck are transferred simultaneously to the carrier by up-and-down motions and right-and-left shifts.

(iii) After dyeing, the cheeses are likewise transferred from the carrier to the mobile truck in the reverse course.

(iv) Whole cheeses on every spindle on the truck are removed from the spindle and lifted up and forced onto spindles of the hydro-extracting basket one after another, or the cheese-mounted spindles are charged into the basket as they are.

(v) After hydro-extraction, the cheeses are discharged from the basket and aligned at conveying location to the dryer and a plural number of the cheeses are transferred at a time to a drying station.

(vi) Dried cheeses are collected to a location where it is easy to house them in cartons with the aid of a positioning jig and a plural number of them are housed simultaneously in each carton by up-and-down motions and right-and-left shifts.

Respective means used for the method and apparatus of this invention will be described hereinbelow in more detail, which means are improved ones over my previously proposed means and commercially available ones.

According to this invention, hence, it is easy to effect sequential cheese dyeing steps including inserting of cheeses on empty spindles, cheese pressing, loading on the carrier, dyeing, hydro-extraction, drying and boxing up. Further, it is possible to attain rationalization by using such devices that operate mainly by reason of three-dimensional orthogonal movements and rotation between the respective steps, whereby efficient cheese dyeing can be automatically achieved.

Stated another way, by virtue of the conveyance of spindles mounted on the crawler trucks following the rail, the foregoing respective steps can be operated sequentially with the travelling of the trucks, and consequently, it is possible to save and omit labor to the utmost for the operations of conveyance to the dyeing machine, removal after dyeing, automatic charging in the hydro-extractor, automatic discharging, etc., thus delivering eventually products boxed up at the outlet.

It is also possible to adopt partly manual operations, for example, for inserting of cheeses on spindles, locking of cheese-mounted spindles by means of a quick releasable fastener, etc.

This invention can also be applied to other various treatments to cheeses than dyeing.

DESCRIPTION OF THE PREFERRED EMBODIMENTS

The invention will be hereinafter described in more detail with reference to the accompanying drawings.

Figure 1:
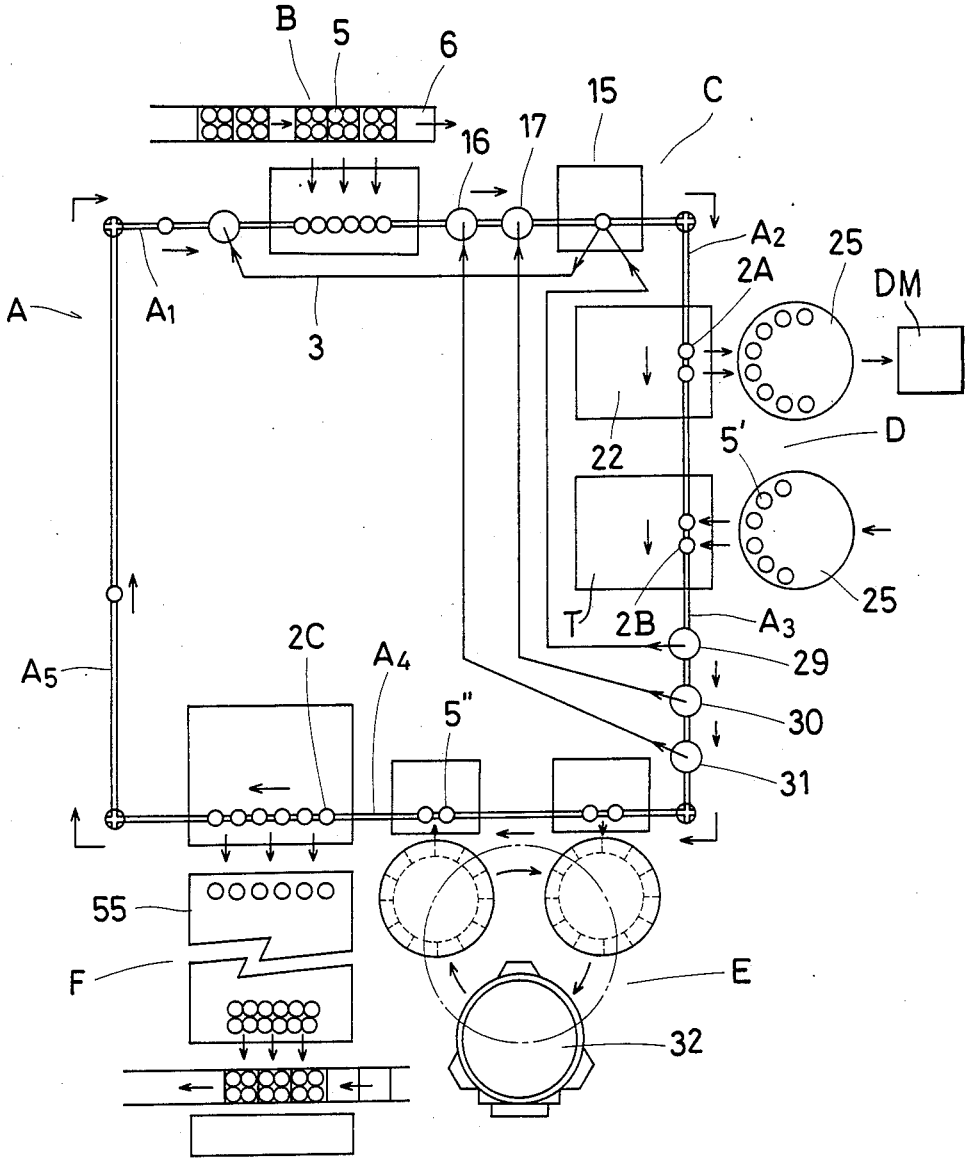
FIG. 1 is a schematic view showing overall arrangement of an apparatus for carrying method of this invention into effect.

FIG. 1 illustrates a schematic view of the apparatus for better understanding of the entirety of dyeing and hydro-extracting steps pertaining to this invention.

The reference mark A designates a rail for circulation on which mobile trucks are travelled in order to repeatedly carry out the method of this invention continuously in a circulation system and spindles are conveyed on the trucks to subsequent steps or stations in sequence.

According to the conveyance path of spindles on the rail, there are arranged stations for performing a series of steps of this invention comprising a cheese inserting-mounting station or step B, a cheese pressing station or step C, a dyeing station or step D, a hydro-extracting station or step E and a drying station or step F, and respective means and mechanisms for use in these stations or steps are installed.

Now, means for the foregoing steps or stations will be explained.

(A) Spindle Conveying Rail:

The spindle conveying rail A comprises, in turn from upstream, an empty spindle rail portion $A_1$, a cheese-mounted spindle rail portion $A_2$, a dyed cheese-mounted spindle rail portion $A_3$, a hydro-extracted cheese-mounted spindle rail portion $A_4$ and an unoccupied spindle returning rail portion $A_5$. The respective rail portions are provided with, in their midway positions, a L-turn link structure for turning the mobile truck carrying thereon spindle in the right-angled direction, if required, and constructed, as a whole, in a linking manner so that the downstream end of the last rail portion $A_5$ may be returned to the original empty spindle rail portion $A_1$ through a L-type turn link structure.

The L-turn link structure for directional turnover is provided with a short-length rail which is rotatable at an angle of 90° at the turnover portion and is of a known structure often utilized for directional turnover.

On the conveyance rail A, there are rested a plurality of mobile trucks 1 which are adapted to be conveyed in turn with required timing and advanced to respective steps or stations. The mobile trucks 1 are stopped optionally at required positions on the rail A and there, respective steps and operations are effected.

(B) Cheese Inserting and Mounting Station:

At this station, on empty spindles 2 which are conveyed there through the empty spindle rail portion $A_1$ by the mobile trucks 1, cheeses 5 are inserted, wherein a yarn is wound up about bobbins, and are ready for subsequent treatments.

Here, empty spindles 2 having a shorter length than the height of the stacked cheeses are used, taking account of cheese compression upon pressing and extension spindles 2' corresponding to a length by which the cheeses are shortened upon pressing are mounted on the spindles 2. Otherwise, if long spindles having a length as long as the height of cheeses in a length by which the cheeses are compressed; after pressing.

Figure 2:
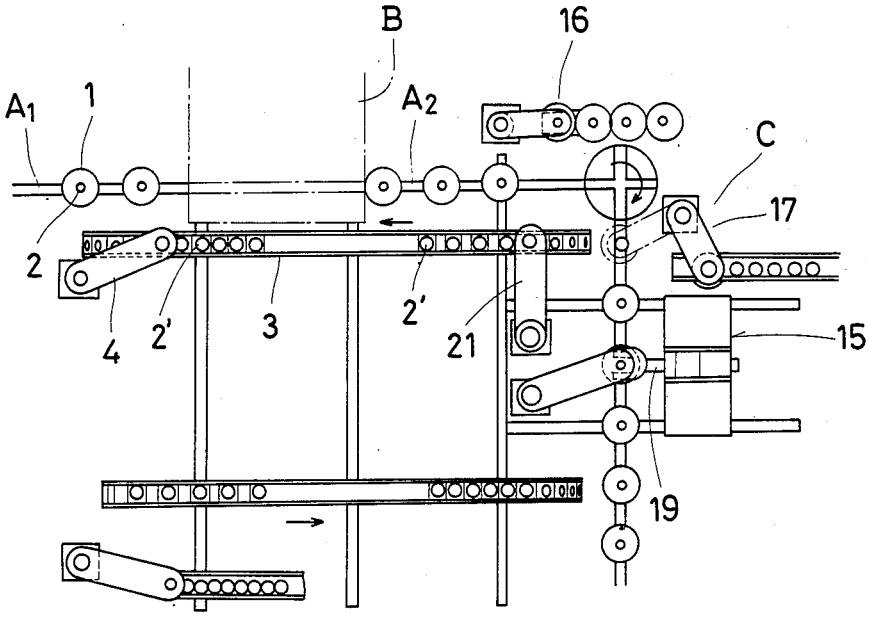
FIG. 2 and FIG. 3 are a diagrammatic plan view and a diagrammatic side view, respectively, of an apparatus of this invention in its cheese-mounting station and pressing station.
Figure 3:
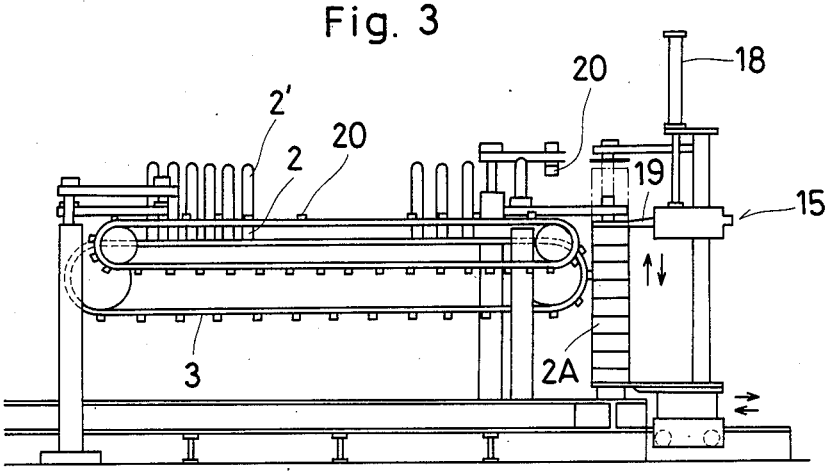

An extension mechanism for the extension spindles 2' is, therefore, installed adjacent to the empty spindle rail portion $A_1$. The extension mechanism comprises, as shown in FIGS. 1 to 3, a conveyor 3 for an extension spindle pool and a transfer and inserting means like a simplified scalar robot having a revolving arm 4, and serves to, upon starting, grasp the extension spindle 2' on the conveyor 3, revolve and insert it on the spindle 2 rested on the mobile truck 1.

The empty spindles 2 surmounted with the extension spindles 2' are advanced through the rail portion $A_1$ towards the cheese inserting and mounting station B.

Figure 4:
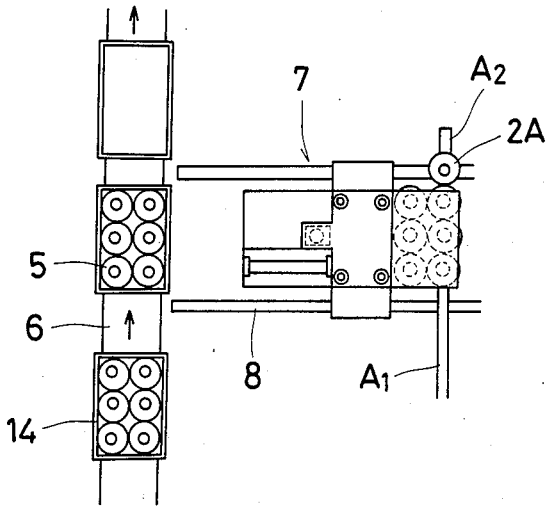
FIG. 4 and FIG. 5 are a diagrammatic plan view and a diagrammatic side view, respectively, of cheese-mounting means.
Figure 5:
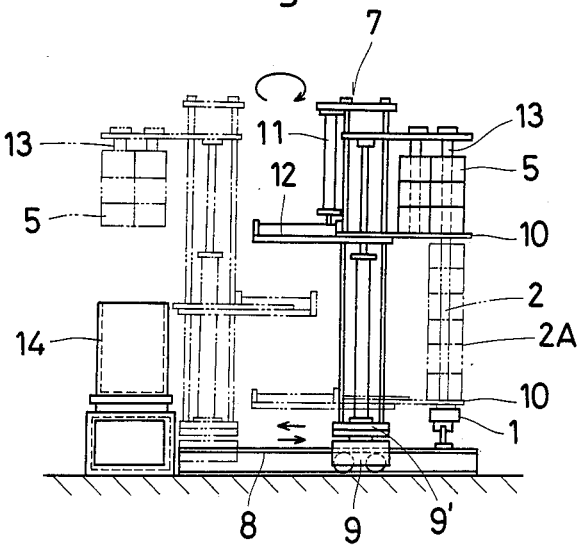

A cheese mounting mechanism, as more specifically shown in FIG. 4 and FIG. 5, comprises a conveyor 6 on which cheeses 5 housed in a carton 14 are adapted to be conveyed and means 7 for unloading the cheeses 5 from the conveyor 3 and inserting them onto the empty spindle assemblies 2,2' and serves to catch an appropriate number of cheeses at their inside, which number may be, for example, eighteen (six cheeses by three tiers) or twenty four (four cheeses by six tiers), lift the cheeses simultaneously from each carton and simultaneously insert them on each spindle assembly 2,2' on the empty spindle rail portion $A_1$.

One example of such cheese unloading and inserting means 7 is, as illustrated in FIGS. 4 and 5, constructed of rails 8, a crawler type or cylinder-actuated truck 9' attached on the truck, a support plate 10 which is provided above the turntable 9' so as to be movable up and down and right and left with the aid of a cylinder 11 for up-and-down movements and a cylinder 12 for right-and-left movements, and a catch bar 13 for holding and lifting cheeses which is disposed above the support plate 10 and has means capable of catching the cheeses inside them.

In operation, first, the catch bar 13 is brought above the carton 14, as shown in FIG. 5, catches at a time a required plural number of cheeses to unload them from the carton 14, transfers them to the empty spindle rail portion $A_1$ with travelling of the truck 9 up to a definite site where the cheeses 5 are turned inversely by 180° by the revolution of the turntable and one column of cheeses (to the right of the figure) are located above an empty spindle. In that state, the support plate 10 is elevated upwardly by the actuation of the up-and-down moving cylinder 11 and then, advanced right by the actuation of the right-and-left moving cylinder 12, and is entered beneath the one column of cheeses located above the empty spindle thereby to release the inside catching and receive the cheeses thereon. Thus, the support plate 10 having the cheeses 5 thereon is caused to descend downwardly and the cheeses 5' are inserted on the empty spindle assembly 2,2'.

Then, the support plate 10 is further advanced to the right to insert likewise another column of cheeses 5 onto another empty spindle assembly 2,2' mounted on the mobile crawler truck.

In this way, when insertion of cheeses on spindles has been terminated, the support plate 10 reverts to the left as shown in FIG. 5 with the aid of the right-and-left moving cylinder 12, is inverted by 180°, advanced to the left with the truck 9 and reached to the location for lifting cheeses from the carton 14. Concurrently, the cheeses 5 inserted on the spindles are shifted to the cheese-mounted spindle rail portion $A_2$ for cheese pressing.

(C) Cheese Pressing Station:

At this station, cheese 5 of the cheese-mounted spindles 2A thus transferred are compressed and prepared for subsequent dyeing and hydro-extracting steps.

To that end, a cheese pressing machine 15 is disposed alongside of the transfer path of cheese-mounted spindles as shown in FIG. 2.

Upstream of the cheese pressing machine, preparatory to cheese pressing, there are disposed spacer attaching means 16 for inserting each spacer on the cheeses mounted on each of the spindles and blind bobbin inserting means 17, whereby spacers and blind bobbins are inserted in sequence on the cheese-mounted spindles manually or with the aid of a simplified scalar robot.

In this case shown in FIG. 2, the circulation rail A has, at each corner, a short-length rail turning by a geared motor and the directional turnover is made by a 90° turning of it.

As a cheese pressing machine 15, a known one proposed by the Applicant is used, which is shown in FIG. 3. In the press machine, the cheese-mounted spindles 2A are pressed down with a press arm 19 by the operation of a hydraulically operating member 18 and a handle, and a slide box is moved downwardly. When each of cheeses is compressed to about ½, the hydraulic cylinder is stopped and the press arm 19 is fitted to retain the cheeses in compressed state.

At this time, since the extension spindles 2' extended on the spindles 2 are exposed above the compressed cheeses, they are required to be removed out prior to locking with quick releasable fasteners 20. To that end, a simplified scalar robot 21 as shown is installed to remove the extension spindles 2' now exposed above with its revolving arm, and the extension spindles are carried on the conveyor 3 for extension spindle pool and returned.

The quick-releasable fastener means 20 is disclosed, for example, in U.S. Pat. No. 4,423,609 and includes upper and lower fasteners, but in FIG. 3, only the upper fastener 20 is depicted.

The cheese-mounted spindles 2A thus pressed and held in compacted state are, consecutively to pressing, transferred following the cheese-mounted spindle rail $A_2$ to the next step, namely, loading to a carrier and dyeing.

(D) Dyeing Station:

The cheese-mounted spindles 2A transferred from the foregoing pressing station C are to be subjected to dyeing step, but prior to entering into a dyeing machine DM, they are loaded on a carrier 25.

Figure 6:
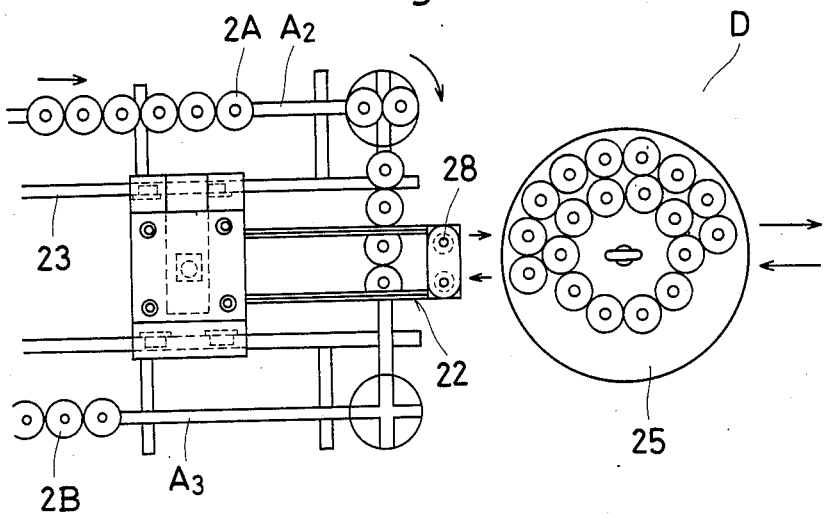
FIG. 6 and FIG. 8 are a diagrammatic plan view and a diagrammatic side view, respectively, showing an embodiment of loading spindles on a carrier.
Figure 7:
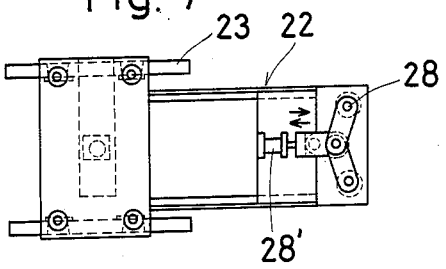
FIG. 7 is a diagrammatic plan view showing a modified embodiment of the major element shown in FIGS. 6 and 8.
Figure 8:
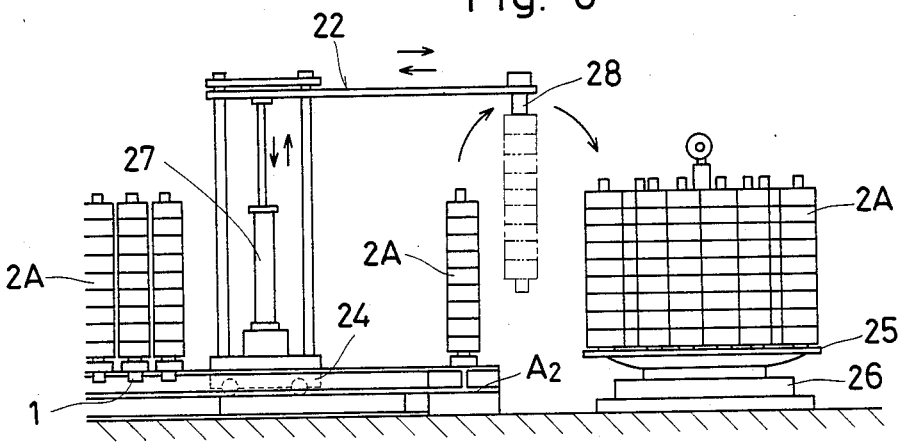

FIG. 6 to FIG. 8 illustrate a manner in which the cheese-mounted spindles 2A are loaded on the carrier 25.

The cheese-mounted spindles 2A rested on the mobile trucks 1 are conveyed following the cheese-mounted spindle rail portion $A_2$, midway on which a spindle transfer device 22 is floatingly attached on a truck 24 so as to be movable to the right and left of FIGS. 6–8 on a rail 23 for the spindle transfer device 22, and serves to transfer and load sequentially the cheese-mounted spindles 2A on the carrier 25 located alongside of the rail $A_2$.

The carrier 25 is rested on a turntable 26 on the floor and adapted to optionally turn to load the cheese-mounted spindles 2A thereon. The loading operation of the spindles 2A onto the carrier 25 can be effected by repeating locking and unlocking operations of the lower and upper quick-releasable fasteners by the use of a robot or by repeated manual operations. In the illustrated example (cf. FIG. 8), a spindle transfer device 22 is used, which effects up-and-down motions and right-and-left movements by means of a hydraulic cylinder 27 and catches every two or three pieces of the spindles 2A simultaneously by means of a catch means 28 at the top end of an arm to mount them on the carrier 25. The catch means 28 is revolved by means of a geared motor.

When the cheese-mounted spindles 2A stop below the spindle transfer device 22, the catch means 28 descends, catches two or three pieces of the spindles 2A concurrently, lifts them up from the mobile trucks 1 and transfers and loads them on the carrier 25, concurrently with which catching is released. In FIG. 6, every two cheese-spindles 2A are caught and loaded on the carrier 25 with the aid of the spindle transfer device 22. The number of catching cheese-spindles 2A at a time is not limited to two, but may be three or more.

FIG. 7 shows another embodiment of a spindle transfer device 22 with which three cheese-spindles 2A are caught at a time for simultaneous loading. In this case, the angle of the catch means 28 is different between the outside row and the inside row of the cheese-spindles 2A arranged on the carrier 25, as compared with the case of two cheese-spindles, and consequently, the angle of the catch means 28 is revised with a hydraulic cylinder 28'.

The turntable 26 is installed on a machine foundation so as to be rotatable while centering on its shaft with the aid of an appropriate driving source (not shown) such as a built-in geared motor, and has an exchangeable receptacle made of plastics rested thereon. While the turntable 26 is revolved by means of a series of gear mechanisms, a plurality of the cheese-mounted spindles 2A are loaded on the carrier 25 rested on the receptacle of turntable.

After the cheese-spindles 2A are loaded on the carrier 25, the carrier 25 is dismounted from the turntable 26 and charged into a dyeing machine (not shown) where they are subjected to dyeing for a required time.

As a dyeing machine, a well-known cheese dyeing machine can be used.

When dyeing has been finished, the carrier 25 carrying thereon dyed cheese-mounted spindles 2B is removed from the dyeing machine and restored on the turntable 26.

(E) Hydro-extracting Station:

From the carrier 25 loading again thereon dyed cheese-mounted spindles 2B thus restored to the turntable 26, the dyed cheese-spindles 2B are demounted by unlocking of the lower quick releasable fasteners and transferred onto the trucks 1 on the dyed cheese-mounted spindle rail portion $A_3$, following which they are conveyed to the next station. Here, in transferring the dyed cheese-spindles 2B to the trucks on the dyed cheese-mounted spindle rail portion $A_3$, for example, a commercially available balance hoist or the like device T is used.

In this way, the trucks 1 mounted thereon with the dyed cheese-mounted spindles 2B are conveyed on the rail portion $A_3$ and travel a required path up to the site of a hydro-extractor 32. In the midway to it, removal of the fasteners 29, dismounting of the blind bobbins 30 and dismounting of the spacers 31 are effected in the reverse order of the preparatory operations to dyeing, by the use of a simplified scalar robot. After the respective preparative operations to hydro-extraction are finished, the cheeses conveyed on the dyed cheese-mounted spindles rail portion $A_3$ are transferred to a hydro-extracting basket 38 disposed alongside of the rail portion $A_3$.

The transfer means to the basket is located at the dyed cheese-mounted spindle rail portion $A_3$ and serves to remove the dyed cheeses 5' from the dyed cheese-mounted spindles 2B. For that purpose, for example, a device disclosed in Japanese Patent Publication No. 52-31462 (1977) may be used.

Figure 9:
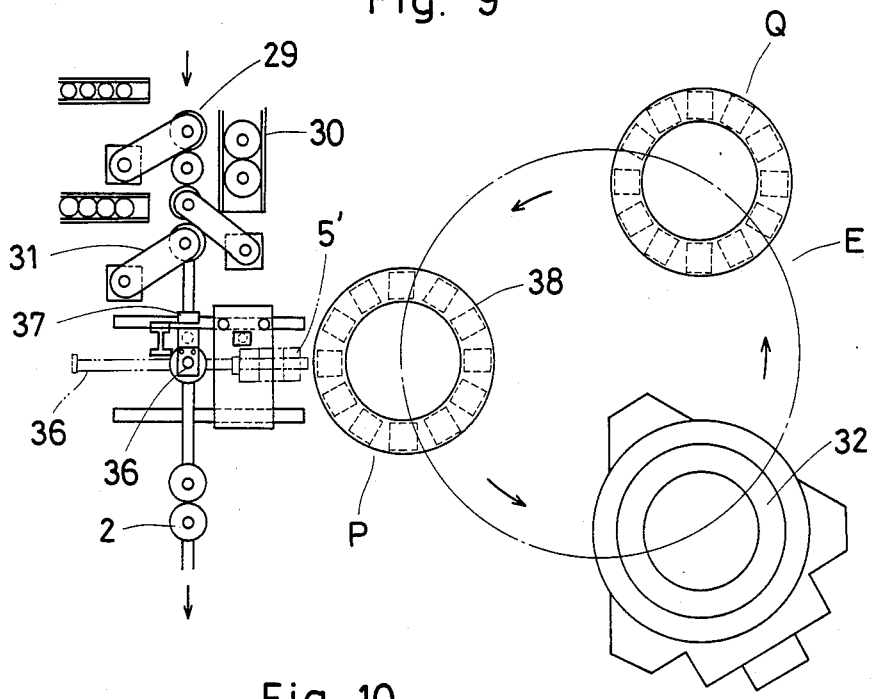
FIG. 9 and FIG. 10 are a diagrammatic plan view and a diagrammatic side view, respectively, of an embodiment of charging cheeses in a hydro-extracting basket.
Figure 10:
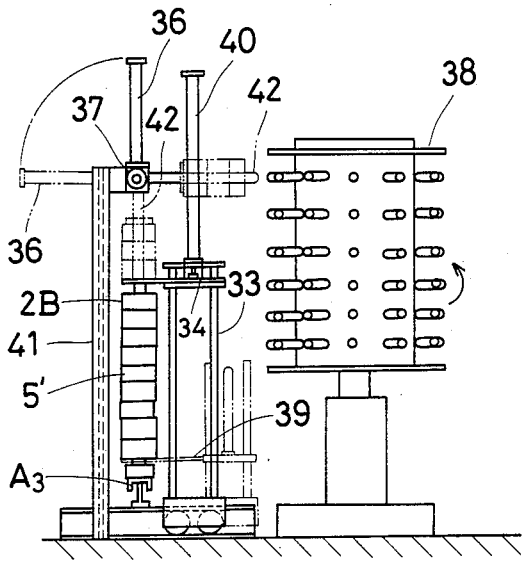

FIG. 9 and FIG. 10 illustrate diagrammatically the apparatus wherein cheese catching means such as a chuck 34 is provided, in the upper part of a machine frame 33 which is movable right and left, so as to be movable up and down and rotatable at an angle range of at least 90°.

The cheese catch means 34 is held at a top of an arm and provided with a cheese-forcing cylinder 36 and a cylinder rotating equipment 37 for the cylinder 36. It is adapted to grasp and hold securely and simultaneously a plurality of the dyed cheeses 5' mounted on spindles which are conveyed on the rail portion $A_3$ at their uppermost portions and turn to place them into the hydro-extracting basket 38 disposed in the adjacent turning range, in sequence.

In the lower part of the machine frame 33, a cheese lifting plate 39 is provided to be movable up and down with the aid of a vertically movable support cylinder 40 in order that it may be convenient to catch the dyed cheeses 5' mounted on the spindles and lift them upwardly.

The reference numeral 41 designates a support column for attaching the ram cylinder rotating equipment 37.

When the dyed cheese-mounted spindles 2B are stopped below the cheese-forcing cylinder 36, the cheese lifting plate 39 is inserted under the cheeses 5' to lift them upwardly and then, they are transferred to a ram spindle 42, as shown in FIG. 10.

The ram spindle 42 is turned by 90° to force the cheeses 5' in every one or plural number into spindles of the hydro-extracting basket 38 and, then, when the basket 38 is turned, to ram the next ones.

In this operation, dropping of the cheeses 5' upon turning at an angle of 90 degree can be prevented either by a support or by an internal catch.

When one cycle of forcing operation of the cheeses onto the spindles of the hydro-extracting basket 38 is finished in this manner, the lift plate 39 descends for the next preparation. In this way, the cheese forcing is consecutively effected while the basket is turned and moved up and down, and mounting of the cheeses on the hydro-extracting basket 38 is completed.

The hydro-extracting basket 38 thus fully rammed with the cheeses 5' is automatically transferred to a hydro-extractor while another hydro-extracting basket 38 which has finished hydro-extraction in the hydro-extractor is automatically shifted to the demounting location.

In the foregoing embodiment, the dyed cheeses 5' are removed from the dyed cheese-mounted spindles 2B and transferred to the cheese-forcing spindles thereby to mount them on the hydro-extracting basket 38.

Figure 13:
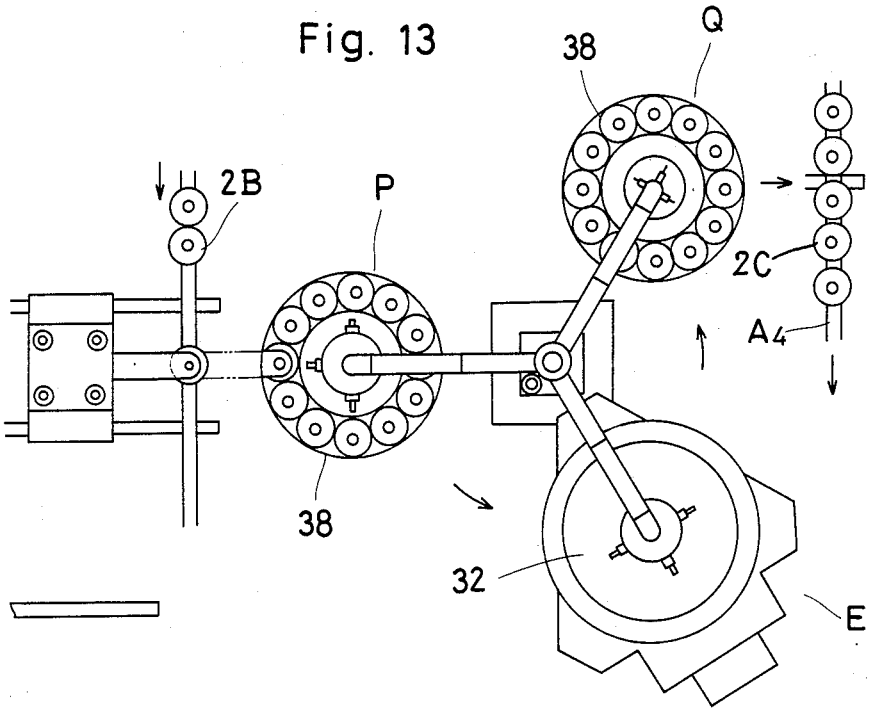
FIG. 13 and FIG. 14 are a diagrammatic plan view and a diagrammatic side view, respectively, of modified embodiment wherein cheese-mounted spindles are placed in a hydro-extracting basket.
Figure 14:
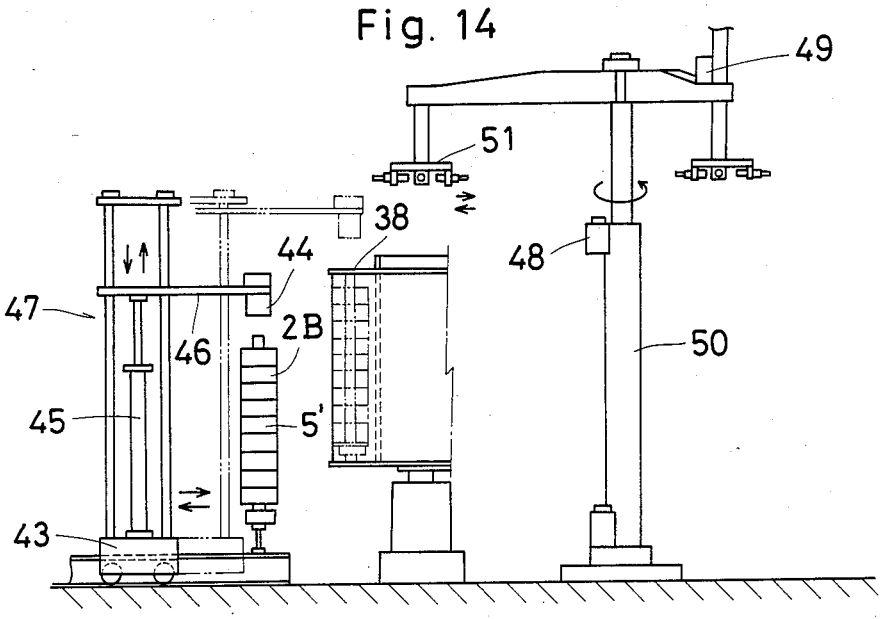

Alternatively, the dyed cheese-mounted spindles 2B may be charged in the basket 38 as they are. FIGS. 13 and 14 illustrate such embodiment. In this case, a spindle inserting equipment 47 is used, which is provided with a spindle catch 44 so as to be movable up and down with a cylinder 45 through an arm 46. The dyed cheese-mounted spindles 2B are stopped near the spindle inserting equipment 47, and there, the spindles are inserted and housed serially into the basket 38 by the horizontal and vertical motions of the arm 46 and the turning of the basket 38.

After hydro-extraction, the cheese-spindles 5' are restored to the trucks 1 on the circulation rail A in the reverse process to the preceding one for transfer to the subsequent step.

In the hydro-extracting apparatus, a hydro-extractor 32 is arranged, constituting substantially an equilateral triangle form together with a hydro-extracting basket 38 at its charging position P for forcing cheeses into it, preparatory to introduction into the hydro-extractor, and a hydro-extracting basket 38 at its discharging position Q for removing cheeses therefrom.

Shifting of the hydro-extracting baskets 38 is conducted by means of a catch means 51 connected to an air cylinder 50 which is of a rotatable transfer mechanism comprising a motor 48 for rotation and a motor 49 for vertical motion of a worm gear system by a reduction geared motor.

As the hydro-extractor 32, a known centrifugal hydro-extractor may be used, on which a plurality of cheeses 5' can be hydro-extracted at a time.

The charging of dyed cheeses 5' into the hydro-extractor 32 and discharging of hydro-extracted cheeses 5'' out of it are automatically performed in one-time timed operation. The cheeses 5'' are restored to the hydro-extracted cheese-mounted spindles rail portion $A_4$ and advanced to the subsequent drying step.

If time is allowed, the transfer into any basket 38 may be omitted. In this case, the hydro-extractor 32 is disposed at the same position as the cheese-spindle loading position P, where loading into the hydro-extractor 32, hydro-extraction and unloading of cheese-mounted spindles are effected.

(F) Drying Station:

The hydro-extracted cheeses 5'' thus subjected to the foregoing step are advanced as hydro-extracted cheese-mounted spindles 2C on the rail portion $A_4$ to the next drying station.

Figure 11:
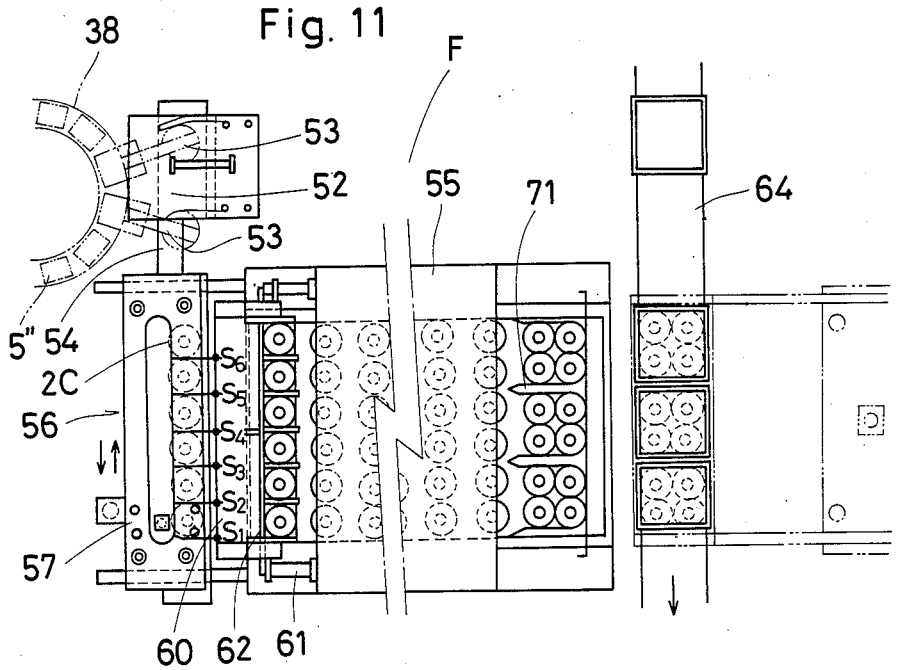
FIG. 11 and FIG. 12 are a diagrammatic plan view and a diagrammatic side view, partly omitted respectively, of an embodiment wherein hydro-extracted cheeses are placed in a dryer.
Figure 12:
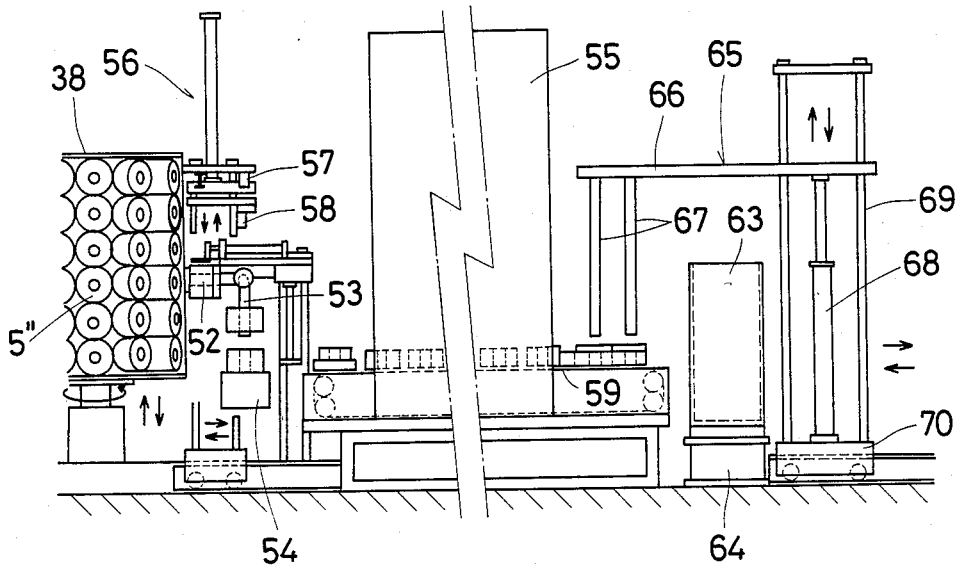

FIG. 11 and FIG. 12 show the state of such advancement from the basket 38 after hydro-extraction to a dryer 55. In these figures, a cheese-drawing equipment 52 is disposed in the vicinity of a transfer path of the spindles 2C so that the hydro-extracted cheeses 5" may be transferred from the hydro-extracting basket 38 to a cheese-transporting conveyor 54 by means of a cheese-turning holder 53 and prepared for forcing into the dryer 55.

The cheese-drawing equipment 52 is constructed so that a drawing claw plate may be reciprocated as required by means of a cam panel and a hydraulic cylinder. The cheese-turning holder 53 provided in the equipment 52 houses therein a geared motor and effects operations of catching, turning, releasing from catching, and reverse turning, in this sequence. For these operations, of course, a robot mechanism may be used.

As the dryer 55, for example, a high-frequency, continuous dryer may usually be used. In charging into the dryer 55, the cheeses 5" are beforehand aligned. This is to dry homogeneously a plurality of cheeses (for example, six cheeses in case of FIGS. 11 and 12). To that end, a cheese transfer equipment 56 (equipped with search sensors for cheese location $S_1$–$S_6$) is movably attached to a rail transversely crossing the circulation rail A and comprises a cheese-catching-transferring member 57 and a cheese catching bar 58 which are associated with the sensors.

On the other hand, the high-frequency, continuous dryer 55 comprises a drying conveyor 59 housed therein, a cheese receiving plate 60, a cylinder 61 for pulling the cheese-receiving plate out and a cheese alignment machine 62.

Charging of cheeses into the high-frequency, continuous dryer 55 are performed as follows:

(a) The hydro-extracted cheeses 5" are simultaneously drawn out by means of the cheese-drawing equipment 52 and received in the turning holder 53 (in FIGS. 11 and 12, every two cheeses are).

(b) The turning holder 53 is turned by 90° and moved to descend to carry the cheeses 5" on the cheese-transporting conveyor 54.

(c) When a first cheese touches the first sensor $S_1$, feeding of cheeses is stopped and the first cheese is transferred to the cheese alignment machine 62 through the cheese catching-and-transferring equipment 56. Similarly, a required number of cheeses 5" (six cheeses in the illustrated embodiment) are mounted, one after another, on the alignment machine 62 by reason of the touching with the respective sensors.

(d) After a required number of the cheeses 5" are mounted in this manner, the receiving plate 60 is pulled out by the operation of the cylinder 61 to carry the hydro-extracted cheeses 5" on the drying conveyor 59 and they are advanced into the dryer 55. At this time, the spindles released from the cheeses are returned to the starting location through the return spindle rail portion $A_5$ as empty spindles for reuse.

After drying, the cheeses are collected to a carton storage location shown to the right of FIGS. 11 and 12 by means of a positioning jig, and every plural number of them are stored by vertical and horizontal motions of a transfer machine 65 in a carton 63 being conveyed with a conveyor 64.

The cheese transfer machine 65 for storing cheeses in cartons 63 is equipped with an arm 66 and catch bars 67 for catching cheeses at the top of the arm 66, and the arm 66 is movable up and down by means of a cylinder 68 and movable right and left by the movement of a machine frame 69, to which the arm 66 is attached, on a mobile truck 70.

The drying conveyor 59 is provided, at its terminal, with a carton-positioning plate 71 as shown in FIG. 11.

The cheeses thus dried are aligned with the positioning plate 71 and held with the cheese catch bars 67 to be stored in cartons 63 followed by counting with a counter which is appropriately provided and packing.

The foregoing explanation concerning the drying step is an embodiment where cheeses released from spindles are transferred to the dryer and dried.

Figure 15:
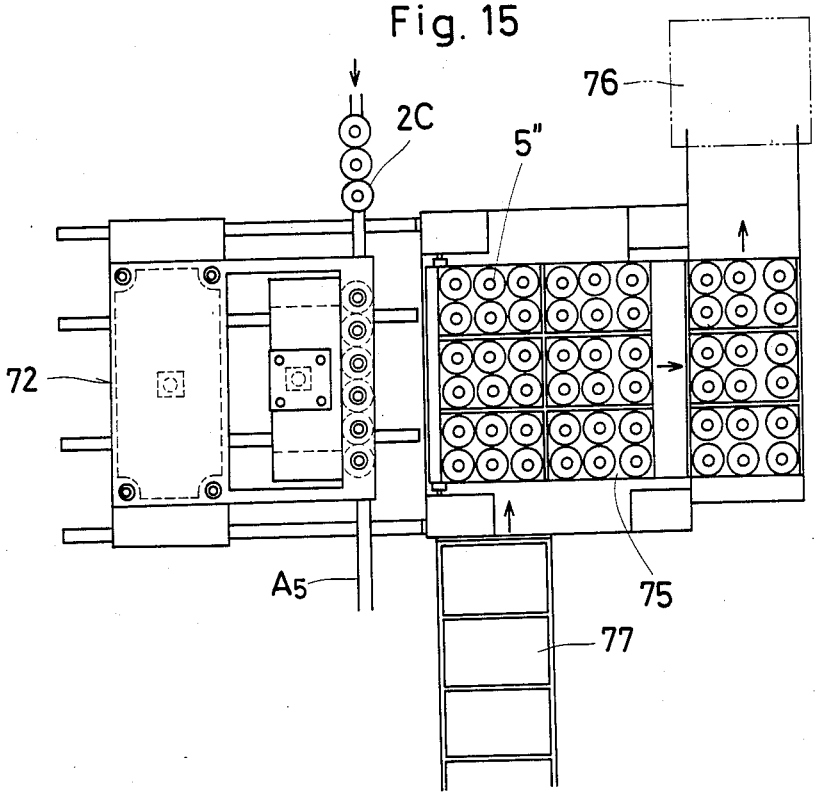
FIG. 15 and FIG. 16 are a diagrammatic plan view and a diagrammatic side view, respectively, showing a modified embodiment wherein cheeses dismounted from spindles are inserted into a dryer.
Figure 16:
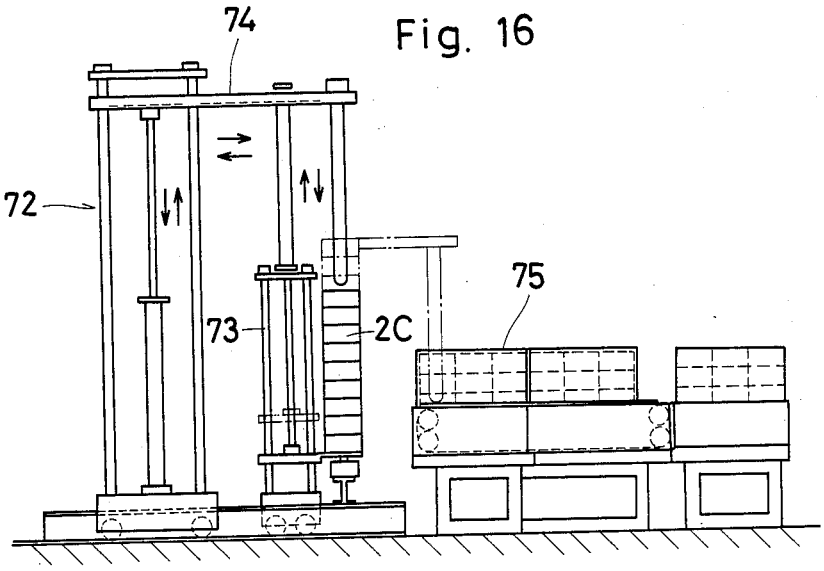

Another embodiment shown in FIG. 15 and FIG. 16 is also possible, wherein dried cheese-mounted spindles 2C are, as they are, brought in front of the dryer and then, prior to the drying step, the cheeses are released from the spindles and charged into the dryer.

This alternative embodiment is substantially similar to the foregoing embodiment except that any release mechanism of cheeses from spindles is further required. To that end, a cheese transfer equipment 72 is provided to be movable by means of a truck, which equipment comprises a cheese lift machine 73 based on hydraulic driving and a cheese alignment mechanism 74 based on hydraulic driving.

The cheese lift machine 73 serves to lift, for example, six (piece/tier) by three (tier) cheeses at a time and transfer the eighteen cheeses to a container 75 at a time, thus transferring, at a time, every three container 75 to a dryer 76 such as vacuum dryer. In case of a vacuum dryer, it is preferred to use a plastic container and to force an appropriate number of cheeses into the container at a time. After drying, the containers are discharged from the dryer and changed to a carton in like manner as above. The reference numeral 77 designates empty containers on standby.

According to the steps on the respective apparatuses described above, a sequential system of dyeing and hydro-extraction according to this invention is thus completed and dyed cheese products are delivered.

As thus far described, this invention provides a method of performing continuously a series of steps of mounting cheeses on empty spindles, cheese pressing, loading on a carrier, dyeing, hydro-extraction, drying, and delivery as dyed cheese products. Consequently, the respective steps which have heretofore been performed separately can be integrated and organized and performed in a given installation area. Thus, cheese dyeing can be done as an integrated work and hence, this invention contributes greatly to improvement in cheese dyeing steps owing to saving of labour workers and reduction in dyeing treatment cost as well as enhancement in work efficiency. Further, significant rationalization in dyeing field can be expected.

More specifically, method of this invention allows it to treat a plurality of yarn cheeses at a time in one operation, thus being efficient. On the other hand, the arrangements of this invention allow use of simple equipments and shortening in time and prevention of occurrence of troubles because these equipments rely on maily three-dimensional orthogonal movements and rotation. Moreover, the control to precise positioning aids in enhancing productivity of automation.

The embodiments of the invention in which an exclusive property or privilege is claimed are defined as follows:

1. A method of dyeing and hydro-extracting yarn cheeses collectively comprising the sequential steps of:

mounting empty spindles on mobile trucks and conveying said trucks carrying the spindles thereon following a rail;

inserting extension spindles on said empty spindles;

inserting simultaneously a plurality of yarn cheeses each wound about a bobbin and supplied form a carton on said spindles surmounted with the extension spindles until a definite number has been reached;

attaching spacers;

pressing the cheeses in the spindle direction with the actuation of a press machine;

removing said extension spindles and locking with fasteners, thereby providing cheese-mounted spindles;

mounting said cheese-mounted spindles on the mobile trucks and conveying them following the rail up to a location of a turntable;

loading said cheese-mounted spindles on a carrier on said turntable until a required number has been reached;

charging said carrier thus loaded into a dyeing machine for effecting a cheese dyeing;

subsequently discharging dyed cheese-mounted spindles from said dyeing machine together with said carrier to restore them on the turntable;

mounting and transferring said dyed cheese-mounted spindles on the mobile trucks on the rail;

removing said fasteners and spacers, and then dyed cheeses from the spindles to house a given number of said dyed cheeses in a hydro-extracting basket;

charging said basket thus filled into a hydro-exterior for purposes of undergoing a hydro-extracting treatment;

transferring and aligning hydro-extracted cheeses on a conveyor;

placing said cheeses aligned in a dryer to effect drying for a required time; and delivering and storing dried cheeses in cartons, whereby the sequential steps are performed systematically in their sequence.

2. An apparatus of mass treatment for dyeing and hdyro-extraction of yarn cheeses for performing sequentially a series of inserting yarn cheeses on spindles, loading on a carrier, dyeing, hydro-extracting, drying and boxing up in cartons, which apparatus comprises a combination of means (a) to (h):

(a) spindle transferring rail means having thereon mobile trucks comprising an empty spindle-mounting rail portion for mounting empty spindles on mobile trucks and conveying them to a downstream cheese mounting station, a cheese-mounted spindle rail portion for mounting cheeses wound about bobbins on said empty spindles and conveying cheese-mounted spindles to a downstream dyeing treatment station, a dyed cheese-mounted spindle rail portion for conveying as-dyed cheese-mounted spindles on the trucks to a downstream hydro-extracting station, a hydro-extracted cheese-mounted spindle rail portion for conveying hydro-extracted cheese-mounted spindles on the trucks to a downstream drying station, and a return rail portion for returning unoccupied spindles after removal of dried cheeses to the initial empty spindle mounting station, thus linking them to constitute a circulation system;

(b) cheese inserting and pressing means including a robot disposed alongside of said empty spindle mounting rail portion, said cheese-mounted spindle rail portion comprising extension spindle inserting means, cheese inserting means for feeding a plurality of cheeses from a cheese pool at a time and inserting them on empty spindles conveyed there following the rail until a definite number has been reached, means for inserting spacers and blind bobbins, means for pressing cheeses in the spindle direction, and means for removing said extension spindles after pressing to return them to their initial position and simultaneously locking the top of said spindles with means defining fasteners;

(c) a dyeing machine for dyeing therein cheese-mounted spindles loaded on a carrier, cheese dyeing means disposed alongside of said cheese-mounted spindle rail portion, said as-dyed cheese-mounted spindle rail portion comprising means for loaded cheese-mounted spindles on a carrier in order to charge them in said dyeing machine, a turntable for charging said cheese-mounted spindles loaded on said carrier into said dyeing machine or restoring as-dyed cheese-mounted spindles discharged out of said dyeing machine from the carrier by reason of a turning motion;

(d) cheese transfer means disposed adjacent to said turntable for transferring said as-dyed cheese-mounted spindles onto downstream trucks on said dyed cheese-mounted spindle rail portion;

(e) releasing means for releasing said fasteners, said blind bobbins and said spacers from said dyed cheese-mounted spindles, which release means is disposed alongside of said dyed cheese-mounted spindle rail portion;

(f) hydro-extracting means disposed alongside of said hydro-extracted cheese-mounted spindle rail portion and adjacent to said releasing means, said hydro-extracting means comprising a hydro-extractor, a hydro-extracting basket, transfer means for transferring dyed cheeses into said hydro-extracting basket to accommodate said cheeses in said hydro-extractor, charging said hydro-extracting basket filled with said cheeses into said hydro-extractor by hanging said cheeses, means for discharging hydro-extracted cheeses together with said hydro-extracting basket at a discharge location and transferring said hydro-extracted cheeses to mobile trucks travelling on said rail;

(g) drying means comprising cheese transfer means for aligning hydro-extracted cheeses thus discharged and travelled on said hydro-extracted cheese-mounted spindle rail portion in every plural number and a dryer for receiving therein said cheeses;

(h) delivery means for receiving dried cheeses thereon to convey them to the location of cartons which means is disposed at the outlet of said drier.

3. An apparatus for mass treatment of dyeing and hydro-extraction of yarn cheeses as claimed in claim 2, wherein said hydro-extracting means comprises a first hydro-extracting basket into which dyed cheeses are forced preparatory to hydro-extraction, a second hydro-extracting basket placed in said hydro-extractor and wherein as-dyed cheeses are hydro-extracted and a third hydro-extracting basket from which hydro-extracted cheeses are discharged, said baskets being located constituting a substantially equilateral triangle form and automatically movable at a timed operation to the next locations.

4. An apparatus for mass treatment of dyeing and hydro-extraction of yarn cheeses as claimed in claim 2, wherein said hydro-extracting means (f) comprises a hydro-extractor, a hydro-extracting basket, transfer means of dyed cheese-mounted spindles into said hydro-extracting basket, means for charging said basket filled with said dyed cheese-mounted spindles into said hydro-extractor by suspending, and means of discharging hydro-extracted cheese-mounted spindles together with said basket and transferring said hydro-extracted cheese-mounted spindles to mobile trucks travelling on said rail means.

* * * * *

UNITED STATES PATENT AND TRADEMARK OFFICE

CERTIFICATE OF CORRECTION

PATENT NO. : 4 796 320

DATED : January 10, 1989

INVENTOR(S) : Nobutaka ONO

It is certified that error appears in the above-identified patent and that said Letters Patent is hereby corrected as shown below:

On the face of the patent, change the Application Number from "129 859" to ---139 859---.

Column 13, line 6; change "form" to ---from---.

Column 13, line 32; change "hydro-exterior" to ---hydro-extractor---.

Column 16, line 1; change "means of" to ---means for---.

Signed and Sealed this

Twenty-sixth Day of September, 1989

*Attest:*

DONALD J. QUIGG

*Attesting Officer*

*Commissioner of Patents and Trademarks*